US007069962B2

(12) United States Patent
Cheng

(10) Patent No.: US 7,069,962 B2
(45) Date of Patent: Jul. 4, 2006

(54) WIRE CUTTING AND TWISTING TOOL WITH SPOOL ASSEMBLY AND MANUAL WIRE FEEDING MECHANISM

(76) Inventor: Dara Cheng, P.O. Box 710895, San Diego, CA (US) 92171

( * ) Notice: Subject to any disclaimer, the term of this patent is extended or adjusted under 35 U.S.C. 154(b) by 0 days.

(21) Appl. No.: 10/926,693

(22) Filed: Aug. 27, 2004

(65) Prior Publication Data

US 2006/0042713 A1 Mar. 2, 2006

(51) Int. Cl.
*B21F 15/04* (2006.01)

(52) U.S. Cl. ..... 140/123; 140/57; 140/119

(58) Field of Classification Search ..... 140/123, 140/57, 119, 93 A, 93.6, 118
See application file for complete search history.

(56) References Cited

U.S. PATENT DOCUMENTS 1,209,434 A * 12/1916 Hayden ..... 140/93 A
1,387,249 A * 8/1921 Foulder ..... 140/119
1,472,763 A * 10/1923 Pomeroy ..... 140/119
1,740,392 A * 12/1929 Donaldson ..... 140/119
2,400,769 A * 5/1946 Morris ..... 140/119
2,682,063 A * 6/1954 Miloche ..... 7/107
2,725,902 A * 12/1955 Giuliano ..... 140/118
2,737,983 A * 3/1956 Pray ..... 140/118
2,908,132 A * 10/1959 Klemm ..... 57/1 R
3,091,264 A 5/1963 Stanford
3,092,152 A * 6/1963 Neff ..... 140/119
3,593,759 A 7/1971 Wooge
3,603,497 A * 9/1971 Nishikawa ..... 227/76
3,677,308 A * 7/1972 Sarff et al. ..... 140/93.6
4,448,225 A 5/1984 Schmidt
4,842,025 A * 6/1989 Box et al. ..... 140/119
5,501,251 A 3/1996 Vader
5,669,425 A * 9/1997 Verlato ..... 140/119
5,836,137 A 11/1998 Contreras et al.
5,983,473 A * 11/1999 Yuguchi et al. ..... 29/33 F

* cited by examiner

*Primary Examiner*—Dmitry Suhol
(74) *Attorney, Agent, or Firm*—Eric Hanscom

(57) ABSTRACT

A wire twisting tool with a spool assembly, locking mechanism, manual wire feeding mechanism, and cutting jaws is claimed. The tool is designed to quickly and efficiently cut wire and twist it, utilizing a series of matching grooves into which are placed two steel balls which allow the cutting and twisting head portion to rotate about the body portion as the body portion is pulled back by a user.

8 Claims, 4 Drawing Sheets

WIRE CUTTING AND TWISTING TOOL WITH SPOOL ASSEMBLY AND MANUAL WIRE FEEDING MECHANISM

CROSS REFERENCE TO RELATED APPLICATIONS

None.

STATEMENT REGARDING FEDERALLY SPONSORED RESEARCH OR DEVELOPMENT

This invention was not federally sponsored.

BACKGROUND OF INVENTION

Tools to cut wire have been popular for centuries, as have been wire twisting devices. These types of tools are commonly used in construction, where wire is used to attach two pieces of rebar prior to pouring slabs or columns. Wire twisting and cutting devices are also frequently used to attach fences to posts, repair holes in fences, and wire pieces of reinforcing bar together when pouring concrete slabs and making concrete posts and ceilings. Taking the ends of a piece of wire and twisting them by hand is an extremely time-consuming and strenuous task.

While the prior art has examples of tools which are designed to cut and twist wire, the current invention is the first to combine in an inexpensive hand tool an ergonomic fit, a method of regulating the output and intake of wire, a protective covering over the wire before it leaves the tool, and an efficient cutting and twisting ability which does not twist the wire inside of the tool body itself and can be accomplished using only hand strength without relying on electrical or battery power.

U.S. Pat. No. 5,836,137 to Contreras (1998) teaches an intermittent rotable pneumatic drive which gathers material around an article for tying, but this machine is expensive, cannot be operated by hand, and would not be convenient to use in a construction setting where a small hand tool would be much more convenient.

U.S. Pat. No. 3,091,264 to Stanford (1963), U.S. Pat. No. 3,593,759 to Wooge (1971), and U.S. Pat. No. 4,448,225 to Schmidt (1984) teach hand tools which would be convenient to use on a construction site, but require as part of their operation that the supply wire be twisted, thereby creating a potential for jamming problems with the supply wire.

U.S. Pat. No. 5,501,251 to Vader (1996) teaches a hand tool which has a supply of wire which is twisted by the tool and cut by additional pulling on the tool, but this tool is not ergonomically designed, requires an external source of wire, thereby decreasing its ease of use, and requires the addition of a commercially available ratchet spring return twister rather than having the twisting mechanism built into the tool.

The current invention meet the long-felt need for an inexpensive, easy to use hand tool that is ergonomically designed for the human hand, and supplies wire from an internal spool which can easily be refilled or replaced by a user, has a cranking mechanism to extrude wire from the jaws of the tool or wind back in excess wire, has jaws to cut the wire and a groove and steel ball mechanism to twist the wire was the user pulls back on the tool.

BRIEF SUMMARY OF INVENTION

It is therefore an object of this invention to provide an inexpensive, simple and efficient method of cutting and twisting cutting wire with a tool that is ergonomically comfortable and efficient, and can be used without reliance on electrical or battery power.

It is a further object of this invention to provide a means by which the wire can be fed out through the jaws of the tool through means of a spool.

It is an additional object of this invention that the wire inside the body cavity of the tool is protected from dirt and debris by the tool body, and that the wire inside the body cavity is not twisted by the tool.

Other and further objects and features of this invention will be apparent to one skilled in the art.

DETAILED DESCRIPTION OF THE INVENTION

Figure 1:
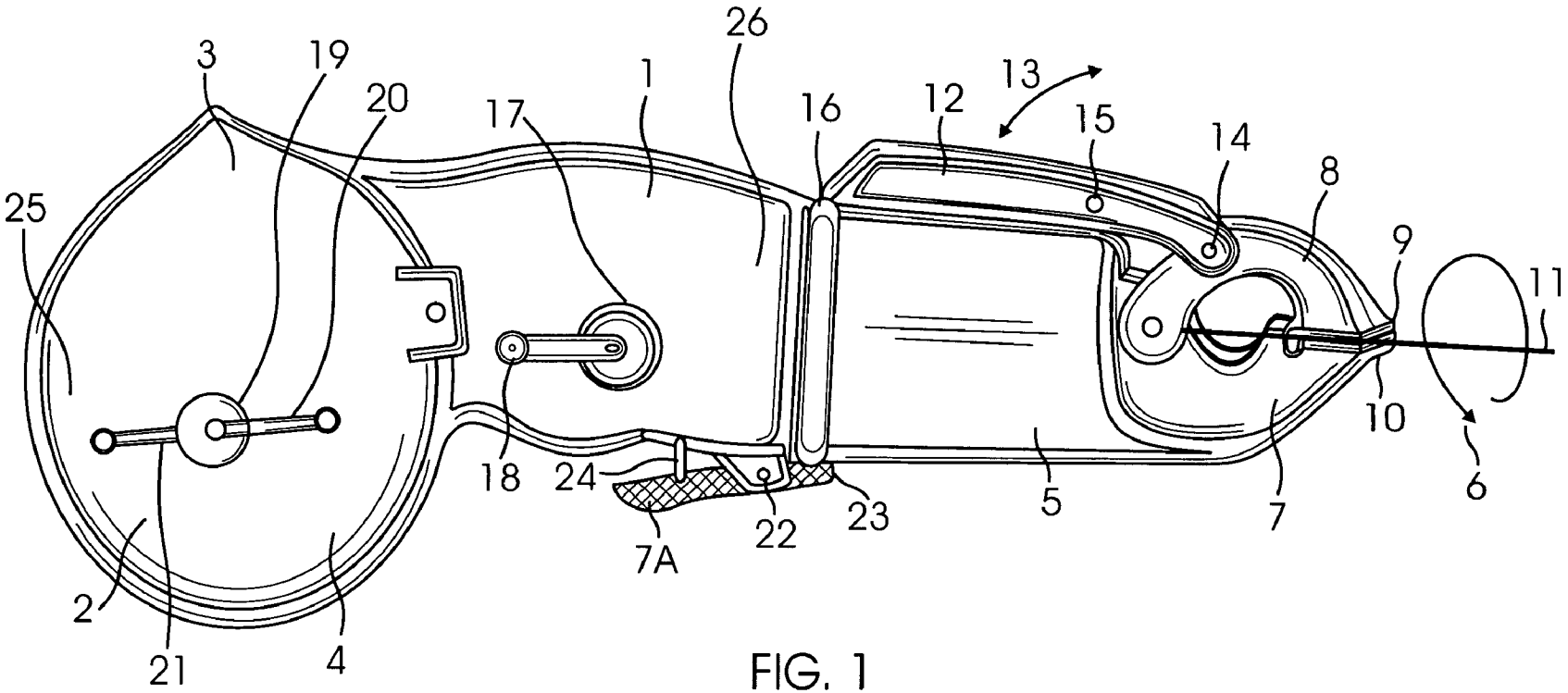
FIG. 1 is a side view of the invention show the major external parts, as well as the wire twisting capabilities.

The present invention is directed to a tool which can easily and efficiently twist and cut wire which is fed through the jaws of the tool by means of a spooling assembly and a cranking mechanism.

Referring to the drawings the invention consists of a spool of wire held inside of the tool body, where the wire is fed out through the jaws of tool where the wire is cut, and a series of grooves and steel balls allows the wire to be twisted by the rotating tool head. The tool consists of four detachable parts, a tool body in which the spool is located, the tool head portion where the jaws and grooves are located, a locking ring which attaches the head portion to the tool body, and two steel balls which sit in indentations in the tool body and cause the head portion to spin and twist the wire before it is cut.

FIG. 1 is a side view of the tool. The tool consists of four parts, three of which are visible here. A tool body (1) is comprised of two tool body parts, the right side or first body part is visible in this drawing. The tool body has a palm section (2), which has a palm side (3) and a finger side (4), and is designed to fit comfortably into the hand of a user. The ergonomic fit is a key feature of this invention. The tool body (1) has a spool end (25) and a head end (26). Attached to the head end (26) of the tool body (1), that is, the section furthest away from the palm section (2) is the tool head (5), which can rotate about an axis in a circular direction (6) defined by a wire (11). The wire (11) comes from a spool inside the tool body (not shown in this figure), and passes through an upper jaw member (8) and a lower jaw member (7) of the tool head (5), and between a cutting blade (9) located at the tip of the upper jaw member (8) and a cutting slot (10) located at the tip of the lower jaw member (7). The tool head (5) rotates around a device comprised of grooves and steel balls, not shown in this figure. The wire (11) is cut by the jaw mechanism, and then gripped between the upper jaw member (8) and the lower jaw member (7) to be twisted. To prevent the tool head (5) from rotating at times when such rotation is undesirable, the invention has a quick release locking mechanism (7A), which is attached to a pivot point (22) protruding from the underside of the tool body (1), and has a lock tab (23) which fits into slots (not shown in this figure) in the tool head (5) to prevent the tool head (5) from rotating unless the quick release locking mechanism is pushed against the locking mechanism retaining spring (24) by the fingers of the user and allows a user to detach the tool head (5) from the tool body (1). To cut the wire (11) the upper jaw member (8) has attached to it at a lever pivot point (14) a lever bar (12) which, when pressed against a fulcrum bar (not shown in this figure) at a fulcrum bar pivot point (15), pressure is exerted upon the upper jaw member (8) such that the cutting blade (9) snaps the wire against the cutting slot (10), thereby breaking the wire (11). The lever bar (12) moves in a direction indicated by the number (13). To move the wire either out of the tool or back into the tool, in cases where and excess of wire was pulled out of the tool, there exists a cranking mechanism. The cranking mechanism can be located in one of two positions. In one iteration, the cranking mechanism is located, under number 17, in the middle of the tool body (1), where a crank handle (18) rotates an internal device which moves the wire (11) in and out of the tool. In another iteration, the cranking mechanism is located, under number 19, on the spool end (25) of the tool body (1), where a crank handle (20) can swivel and fit into a crank receptacle (21) built into the tool body.

Figure 2:
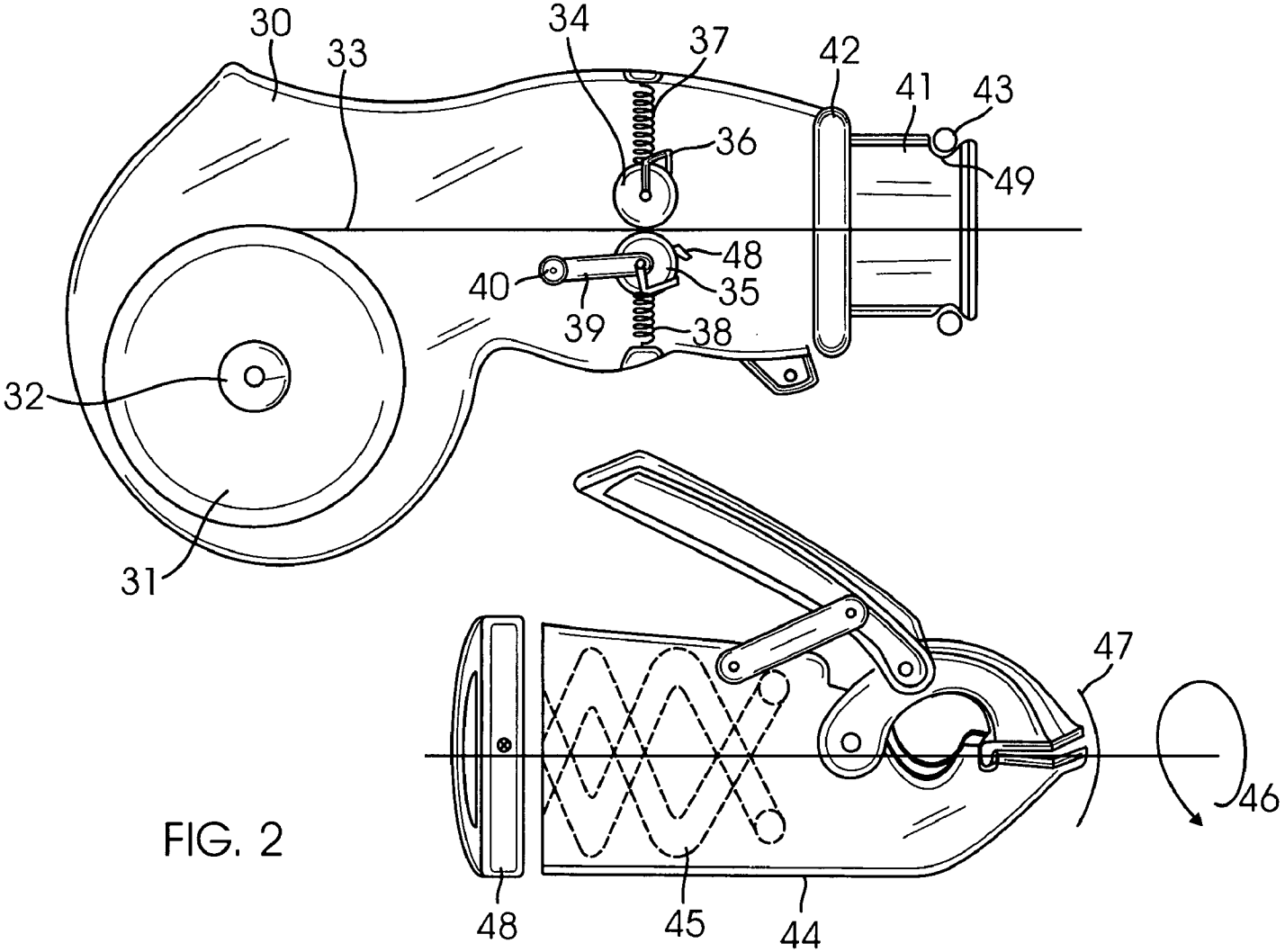
FIG. 2 is a side view of the invention, showing the three main parts: a body part, a head part, and a lock washer. This view shows the inner workings of the invention as well.

FIG. 2 is a cutaway view of the tool, showing some of its internal parts. Looking inside the tool body (30), there is a spool (31) which rotates about a spool axel (32). There is a length of wire (33) wound around the spool (31). The wire (33) feeds from the spool (31) through a guiding and movement restriction device consisting of an upper cylinder (34) which rides over the wire (33) and has built into it an upper wire guide, (not shown in this figure), which is a semi-circular indentation in the middle of the surface slightly larger than the diameter of the wire (33) which serves to guide the wire (33) in a straight line between the spool (31) and the jaws of the tool (47). There is an upper cylinder attachment rod (36) which anchors the upper cylinder (34) to the first body part (here, the only half of the tool body (30) which is seen), and an upper cylinder spring (37) which maintains a constant pressure in a downward direction on the upper cylinder (34). There is a lower cylinder (35) which is attached to the first body part by a lower cylinder attachment rod (48). The lower cylinder (35) has built into it a lower wire guide, (not shown in this figure), which is a semi-circular indentation in the middle of the surface slightly larger than the diameter of the wire (33) which serves to guide the wire (33) in a straight line between the spool (31) and the jaws of the tool (47). A lower cylinder spring (38) working in conjunction with a lower cylinder attachment structure (48) maintains a constant upward pressure on the lower cylinder (35), thereby restraining the wire (33) in the grooves on the upper and lower cylinders. Attached to the lower cylinder (35) is a winding crank (39) which is turned by a user grasping the winding handle (40) and turning it, thereby moving the wire either on or off the spool (31). Moving further down the tool body (1) away from the spool (31) there is a lock washer (42) which serves to attach the tool head (44) to the tool body (30). The tool head (44) slips over the head end (41) of the tool body (30). There are two steel balls (43) located in indentations (49) in the head end (41) which fit into a series of grooves (45) in the tool head (44), and can turn the tool head (44) as a user pulls back on the tool body (30). There is also a lock washer (48) shown next to the tool head (44) to show how the inside diameter of the locker washer (48) is slightly larger than the outside diameter of the tool head (44), thereby allowing the lock washer (48) to slide over the tool head (44) and lock it in place, after the tool head (44) is slid over the head end (41) of the tool body (30).

Figure 3:
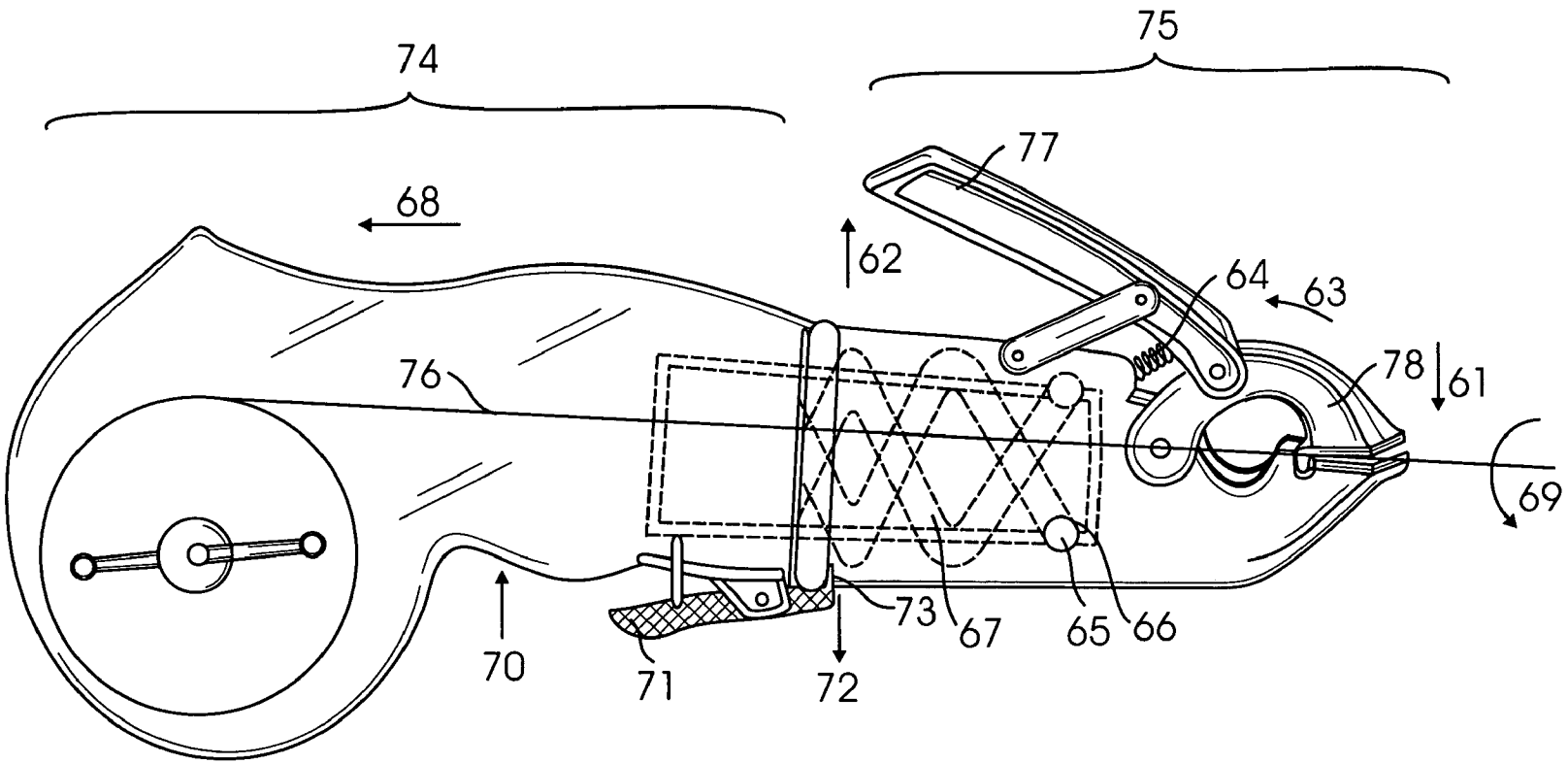
FIG. 3 is a cut-away view of the invention, with the external side of the device closest to the viewer removed to show the internal mechanisms of the invention.

FIG. 3 is a side view of the invention illustrating how the user can cut and twist wire with the tool. When a user wants to cut the wire (76), he/she presses in a downward direction (60) on the lever bar (77), such motion causing the upper jaw member (78) to move in a downward direction (61) to cut the wire. When the user stops putting downward pressure on the lever bar (77), the lever spring (64) pushes the lever bar (77) in an upward direction (62), thereby causing the upper jaw member (78) to move in an upward direction (63), thereby open the jaws. To twist wire, the user first puts the two ends of the wire into the jaws of the tool, and locks the lever bar (77) in a down position, by pushing it down forcefully such that it locks against the tool, then presses in an upward direction (70) on the quick release locking mechanism (71), which causes the lock tab (73) to move in a downward direction (72), thereby unlocking the tool head (75) from the tool body (74). As the user then pulls back, in a direction illustrated by the number (68), the steel balls (65) sit in their indentations (66) and the tool head (75) rotates in a direction indicated by number (69) as the grooves (67) cause the tool head (75) to spin around, twisting the wire. When the wire has been twisted to the extent desired, the user unlocks the jaws of the tool by pulling upward on the lever bar (77), thereby opening the jaws.

Figure 4:
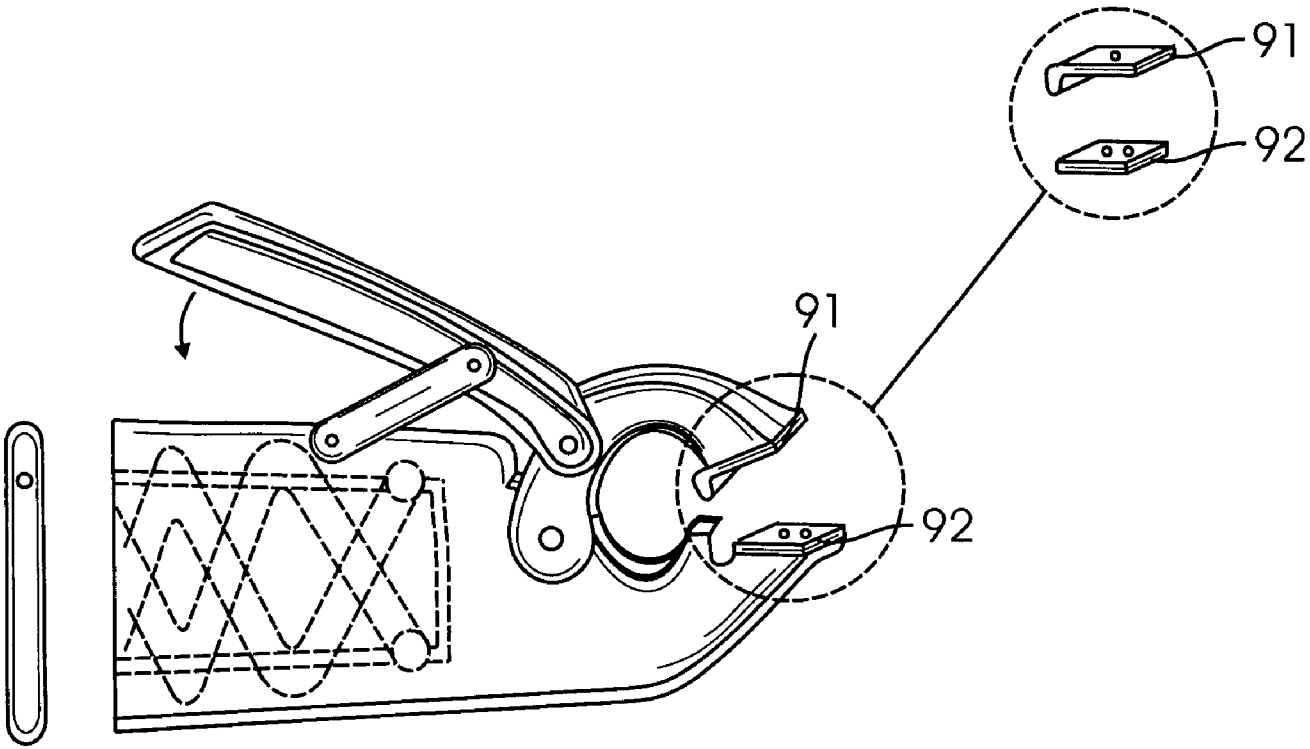
FIG. 4 is a partial elevational view of the invention, showing a close-up of the jaw mechanisms.

FIG. 4 is close-up view of the tool head, showing how the cutting blade (91) and the cutting slot (92) can be replaced or removed for sharpening should they become dull.

What I claim is:

1. A tool for spooling, cutting, and twisting wire, comprising:

a tool body with a spool end and a head end, where the spool end is shaped to fit conveniently into a human hand, and the head end is a cylinder, and an upper side, over which fits a user's palm, and a lower side, over which fits a user's fingers, a first body part and a second body part manufactured to fit together to form the tool body, where the tool body has a comfortable, ergonomic fit to the human hand which facilitates a user's holding and pulling on the tool, a quick release means of fastening the first body part to the second body part, namely a quick release locking mechanism, such that opening the tool body can be accomplished quickly and easily by a user to replace wire, lubricate internal parts, and perform other internal tasks, a spool, consisting of a cylindrical tube with two sides such that wire can be coiled upon the spool for storage and easy removal, with an orifice in the center of the cylindrical tube through which an axel can fit to retain the spool in a desired location, located inside a tool cavity, the tool cavity being defined as a space in between the first body part and the second body part, where the spool rotates freely about a spool axel which projects from the first body part, where the spool axel projects outwardly from the first body part, and when the spool is placed on the spool axel and the second body part is attached to the first body part, the spool is prevented from falling off the spool axel by the second body part being attached to the first body part in such proximity to the end of the spool axel that the spool cannot fall from the spool axel, and is manufactured with a length such that the end of the spool axel fits into a receiving socket located on the second body part when the first body part and the second body part are attached together, where the spool can be easily removed from the tool body for replenishment of wire or replacement, but which, when the first body part is attached to the second body part cannot fall from the spool axel, a winding crank located on the side of the upper side section of the tool body which can unwind wire out through the jaws of the tool for cutting and twisting, or rewind excess wire onto the spool depending on the direction it is cranked by a user, a wire round around the spool, which is then strung through the tool cavity such that it exits the tool cavity in a manner in which the wire can be used by a user to tie together external materials, a tool head comprising two ends: a cylindrical spool end located at the portion of the tool head closest to the winding crank on the tool body, which fits over the head end of the tool body, and a cutting end, located at the other end of the tool head, which comprises jaws, comprising an upper jaw member and a lower jaw member, which cut the wire and are attached to one another at a jaw pivot point, and a lever device, comprising a lever bar which provides a fulcrum bar against which the lever bar can apply force through a connection between the lever and the upper jaw member at a lever pivot point, the purpose of the lever device being to apply sufficient pressure to the upper jaw member to cut wire, where there is a lever spring attached between the end of the lever closest to the upper jaw member and the cylindrical section of the tool head, and a spindle section which, when attached to the tool body extends into the tool body, where the first body part and the second body part have manufactured into their sides two ball indentations, each with a diameter slightly larger than a steel ball, the ball indentations being semicircular indentations into the head end of the tool, there are two steel balls located in the ball indentations, the tool head has manufactured into it a series of grooves, made with a diameter slightly larger than the diameter of the steel ball, where as the tool body is pulled back by the user, the tool head rotates around as the series of grooves manufactured into the tool head rotate about the two steel balls located in the ball indentations of the tool body, and a lock washer which fits over the cylindrical spool end of the tool head, located at the portion of the tool head closest to the winding crank on the tool body, and fixes the tool head to the tool body.

2. The tool of claim 1, where:

the length of wire is held in place within the tool cavity by a restraining mechanism, which comprises an upper cylinder and a lower cylinder, where the upper cylinder and the lower cylinder are metal cylinders each having a thin groove in the middle of their surfaces, where the groove has a diameter slightly larger than the wire such that the wire is restrained between the groove on the upper cylinder and the groove on the lower cylinder, where the upper cylinder has a spring located between it and the first body part, such that the upper cylinder is under pressure, pushing against the lower cylinder, where the upper cylinder is attached to the first body part by an upper cylinder attachment rod which projects from the first body part and is of a length that locates the upper cylinder directly in the middle of the body cavity, where the lower cylinder is attached to the first body part by a lower cylinder attachment rod which projects from the first body part and is of a length that locates the lower cylinder directly in the middle of the body cavity, where the lower cylinder has a lower cylinder tension device which presses the lower cylinder up against the upper cylinder.

3. The tool of claim 2, where:

the winding crank is attached to the lower cylinder such that turning the winding crank turns the lower cylinder to feed wire out or wind in excess wire.

4. The tool of claim 3, where:

the jaws consist of two jaw members, the upper jaw member having a cutting blade which fits into a cutting slot manufactured into the lower jaw member.

5. The tool of claim 4 where:

the tool body has a quick release locking mechanism attached to its lower surface, the locking mechanism comprising a spool end, which, when pulled up by a user's fingers, removes a latch into the spindle of the tool head, effectively unlocking the tool head, the natural state of the tool being locked serves to prevent the jaws from accidentally rotating and/or cutting the wire, the locking mechanism being attached to the lower surface of the tool body by a locking mechanisms pivot point, thereby creating the situation where a user, by pulling up with his/her fingers and pulling back, can effectively unlock the tool head and twist the wire by merely grasping the tool and pulling.

6. The tool of claim 5, where:

the spool axel has a winding lever attached to it which allows a user to rewind the spool, to rewind onto the spool any excess wire, the winding lever being attached to the spool axel through a hole in the second body part.

7. The tool of claim 2, where:

the lock washer attaches the tool body to the tool head by means of friction, where the tool head comprises two ends: the cylindrical spool end located at the portion of the tool head closest to the winding crank on the tool body, which fits over the head end of the tool body, and the cutting end, located at the other end of the tool head, which comprises jaws, and the tool body comprises two ends, a spool end and a head end, where the spool end is shaped to fit conveniently into a human hand, and the head end is a cylinder, whereby the head end of the tool body and the spool end of the tool head are both slightly tapered such that when the lock washer is pushed back against a stop on the tool body sufficient pressure is applied to the spool end of the tool head that it maintains its position at the tool head end of the tool body, but still allow the tool head to rotate freely about the two steel balls.

8. The tool of claim 2, where:

the lock washer attaches the tool body to the tool head by means of screw threads, where the tool head comprises two ends: the cylindrical spool end located at the portion of the tool head closest to the winding crank on the tool body, which fits over the head end of the tool body, and the cutting end, located at the other end of the tool head, which comprises jaws, and the tool body comprises two ends, a spool end and a head end, where the spool end is shaped to fit conveniently into a human hand, and the head end is a cylinder, whereby the head end of the tool body has manufactured into its surface a series of screw threads, into which matching screw grooves manufactured into the spool end of the lock washer, the spool end of the tool head has a pull plate manufactured into it, where the pull plate is a narrow flange projecting out at 90 degrees from the direction of the spool end of the tool head, and where the head end of the lock washer has a grabbing plate manufactured into the head end of the lock washer, where the grabbing plate is a narrow flange projecting out at 90 degrees from the direction of the screw grooves in the spool end of the lock washer, but still allow the tool head to rotate freely about the two steel balls.

* * * * *